US008613437B2

(12) United States Patent
Watanabe et al.

(10) Patent No.: US 8,613,437 B2
(45) Date of Patent: Dec. 24, 2013

(54) SHEET IDENTIFICATION DEVICE, IMAGE FORMING APPARATUS, AND COMPUTER READABLE MEDIUM

(75) Inventors: Kiyoshi Watanabe, Kanagawa (JP); Kiminobu Tsutada, Kanagawa (JP); Hiroyuki Tamai, Kanagawa (JP); Hiroaki Magaribuchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 119 days.

(21) Appl. No.: 13/292,249

(22) Filed: Nov. 9, 2011

(65) Prior Publication Data

US 2012/0308244 A1 Dec. 6, 2012

(30) Foreign Application Priority Data

Jun. 6, 2011 (JP) ..... 2011-126291

(51) Int. Cl.
*B65H 3/44* (2006.01)
*B65H 5/26* (2006.01)
*B65H 7/02* (2006.01)

(52) U.S. Cl.
USPC .... 271/9.01; 271/9.06; 271/259; 271/258.03; 271/265.02

(58) Field of Classification Search
USPC ..... 271/9.01, 9.06, 258.01, 259, 258.03, 271/265.01, 265.02
See application file for complete search history.

(56) References Cited

U.S. PATENT DOCUMENTS 3,951,264 A * 4/1976 Heidecker et al. ..... 206/308.3
7,445,209 B2 * 11/2008 Sano et al. ..... 271/263

FOREIGN PATENT DOCUMENTS

JP 2001-117431 A 4/2001
JP 2002-296980 A 10/2002

* cited by examiner

*Primary Examiner* — David H Bollinger
(74) *Attorney, Agent, or Firm* — Sughrue Mion, PLLC

(57) ABSTRACT

A sheet identification device includes plural detecting units, an estimating unit, and an output unit. The plural detecting units are provided along a transport path along which a sheet is transported by a transport unit, and detect passing of the sheet. The estimating unit estimates a length in a transport direction of the sheet as a detection target on the basis of individual detection results generated by the plural detecting units. The output unit outputs, if the length estimated by the estimating unit on the basis of at least one of the detection results is not a predetermined length, a signal indicating that a sheet having a length in the transport direction different from the predetermined length is being transported.

13 Claims, 9 Drawing Sheets

SHEET IDENTIFICATION DEVICE, IMAGE FORMING APPARATUS, AND COMPUTER READABLE MEDIUM

CROSS-REFERENCE TO RELATED APPLICATIONS

This application is based on and claims priority under 35 USC 119 from Japanese Patent Application No. 2011-126291 filed Jun. 6, 2011.

BACKGROUND

(i) Technical Field

The present invention relates to a sheet identification device, an image forming apparatus, and a computer readable medium.

SUMMARY

According to an aspect of the invention, there is provided a sheet identification device including plural detecting units, an estimating unit, and an output unit. The plural detecting units are provided along a transport path along which a sheet is transported by a transport unit, and detect passing of the sheet. The estimating unit estimates a length in a transport direction of the sheet as a detection target on the basis of individual detection results generated by the plural detecting units. The output unit outputs, if the length estimated by the estimating unit on the basis of at least one of the detection results is not a predetermined length, a signal indicating that a sheet having a length in the transport direction different from the predetermined length is being transported.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described in detail with reference to the drawings.

First Exemplary Embodiment

Figure 1:
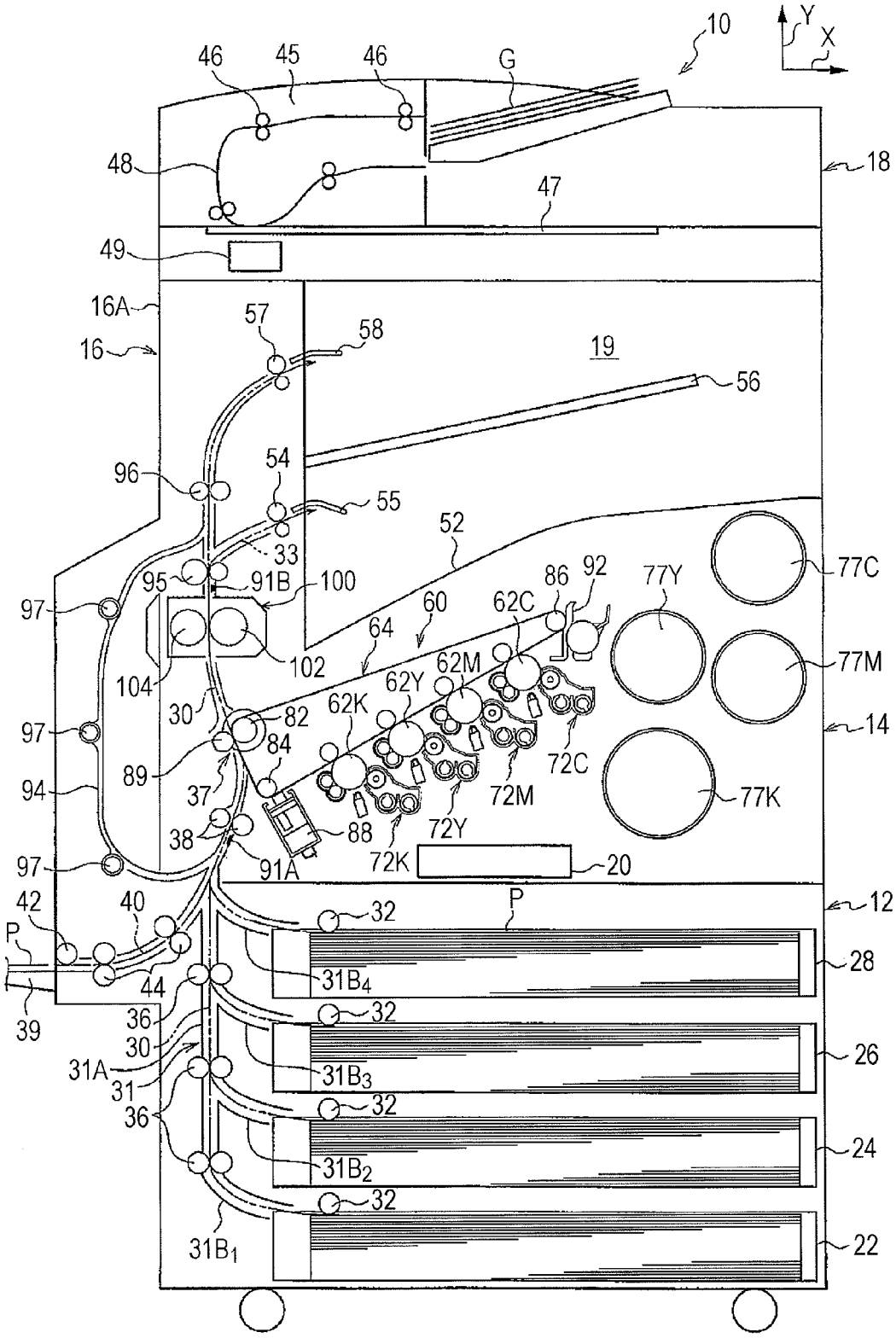
FIG. 1 is a side cross-sectional view illustrating an example of a configuration of an image forming apparatus according to an exemplary embodiment of the present invention.

FIG. 1 is a side cross-sectional view of an image forming apparatus 10 according to a first exemplary embodiment of the present invention. The image forming apparatus 10 includes a sheet accommodating unit 12, an image forming unit 14, an output unit 16, a document reader 18, and a controller 20, which are disposed from the lower side toward the upper side in the vertical direction in a front view of FIG. 1 (Y direction shown in FIG. 1). The sheet accommodating unit 12 accommodates sheets of recording paper P. The image forming unit 14 is provided above the sheet accommodating unit 12 and forms images on sheets of recording paper P fed from the sheet accommodating unit 12. The output unit 16 is provided above and to the left of the image forming unit 14 by being integrated with the image forming unit 14, and outputs sheets of recording paper P on which images have been formed. The document reader 18 is provided above the output unit 16 and reads a document G. The controller 20 is provided in the image forming unit 14 and controls the operations of the individual units of the image forming apparatus 10. In the description given below, the vertical direction in a front view of FIG. 1 is referred to as a Y direction, and the horizontal direction is referred to as an X direction. Also, "right" and "left" mean right and left in a front view of the image forming apparatus 10.

The sheet accommodating unit 12 includes a first accommodating unit 22, a second accommodating unit 24, a third accommodating unit 26, and a fourth accommodating unit 28 arranged along the Y direction, which accommodate sheets of recording paper P of different sizes. Each of the first accommodating unit 22, the second accommodating unit 24, the third accommodating unit 26, and the fourth accommodating unit 28 (hereinafter referred to as "accommodating unit(s)" when it is not necessary to distinguish between them) is provided with a feed roller 32 for feeding a sheet of recording paper P accommodated therein to a transport path 30. The transport path 30 is defined by a plate-like chute 31 that guides a sheet of recording paper P fed by the feed roller 32 from the sheet accommodating unit 12 to the image forming unit 14 and the output unit 16. The chute 31 includes a main chute 31A and branch chutes $\mathbf{31}B_1$ to $\mathbf{31}B_4$. The main chute 31A guides a sheet of recording paper P from the sheet accommodating unit 12 to the image forming unit 14, and defines a backbone portion of the transport path 30. The branch chutes $\mathbf{31}B_1$ to $\mathbf{31}B_4$ branch off from the main chute 31A, receive sheets of recording paper P fed by the respective feed rollers 32 from the first to fourth accommodating units 22, 24, 26, and 28, respectively, and guide the sheets of recording paper P to the main chute 31A. The branch chute $\mathbf{31}B_1$ corresponds to the first accommodating unit 22. The branch chute $\mathbf{31}B_2$ corresponds to the second accommodating unit 24. The branch chute $\mathbf{31}B_3$ corresponds to the third accommodating unit 26. The branch chute $\mathbf{31}B_4$ corresponds to the fourth accommodating unit 28. Thus, the inlets of sheets of recording paper P in the respective branch chutes $\mathbf{31}B_1$ to $\mathbf{31}B_4$ function as the inlet of the transport path 30.

The main chute 31A is provided with pairs of transport rollers 36, which correspond to the respective outlets of the branch chutes $\mathbf{31}B_1$ to $\mathbf{31}B_3$. Each pair of transport rollers 36 is constituted by a pair of rollers that sandwich a sheet of recording paper P fed by the corresponding feed roller 32 and feed the sheet to the downstream side in a transport direction. The pair of transport rollers 36 having such a configuration temporarily stops a sheet of recording paper P fed by the feed roller 32 at a nip portion and feeds the sheet to the downstream side in the transport direction at a predetermined timing in accordance with control performed by the controller 20.

On the other hand, no pair of transport rollers 36 is provided for the branch chute 31$B_4$. Thus, a sheet of recording paper P fed by the feed roller 32 to the branch chute 31$B_4$ is guided to the main chute 31A by the driving force of the feed roller 32, and is fed to the downstream side in the transport direction.

In the main chute 31A, a pair of positioning rollers 38 is provided on the downstream side of the pairs of transport rollers 36 in the transport direction of a sheet of recording paper P. The pair of positioning rollers 38 temporarily stops a sheet of recording paper P and feeds the sheet to a downstream region (second transfer unit 37) at a predetermined timing. The pair of positioning rollers 38 is disposed such that the peripheral surfaces of the rollers face each other and are in contact with each other. The pair of positioning rollers 38 sandwich a sheet of recording paper P and are rotated by receiving a driving force from a motor 14A (see FIG. 4), thereby feeding the sheet to the downstream side of the transport path 30. The pair of positioning rollers 38 are configured so as not to be rotated by the weight of the pair of positioning rollers 38 and the weight of a gear that connects the pair of positioning rollers 38 and the drive shaft of the motor 14A, even if the leading end of a sheet of recording paper P fed by the feed roller 32 comes into contact with the nip portion and is pushed.

The image forming unit 14 includes a casing 16A, which serves as a body of the apparatus. The casing 16A is configured so that the upper left portion of the image forming unit 14 protrudes toward the upper side with respect to the upper center portion and the upper right portion in a front view of the image forming apparatus 10. The left end portion of the document reader 18 is connected to the upper end of the output unit 16. Accordingly, the image forming apparatus 10 has an output region 19 surrounded by the upper surface of the image forming unit 14, the lower surface of the document reader 18, and the right surface of the output unit 16. Sheets of recording paper P from the output unit 16 are output and stacked in the output region 19.

An auxiliary transport path 40 is provided on the opposite side of the transport path 30 for the image forming unit 14 to the fourth accommodating unit 28. A sheet of recording paper P fed from a foldable manual sheet feeder 39, which is provided on the left surface of the image forming apparatus 10 in a front view of the image forming apparatus 10, is transported along the auxiliary transport path 40 to the transport path 30. The auxiliary transport path 40 is provided with a feed roller 42, which feeds a sheet of recording paper P fed from the manual sheet feeder 39 to the auxiliary transport path 40, and plural pairs of transport rollers 44, which are provided on the downstream side of the feed roller 42 and which transport sheets of recording paper P one by one. The downstream-side end of the auxiliary transport path 40 is connected to the transport path 30.

Also, a fixing device 100 is provided on the downstream side of the second transfer unit 37 along the transport path 30 in the image forming unit 14. The fixing device 100 includes a fixing roller 102 for heating a developer on a sheet of recording paper P, and a pressure roller 104 for pressing the sheet against the fixing roller 102. The fixing device 100 is configured so that, after a sheet of recording paper P has passed through a nip portion N, where the fixing roller 102 is in contact with the pressure roller 104, a developer is fused and fixed, whereby a developer image is fixed onto the sheet. In the image forming apparatus 10 according to the first exemplary embodiment, a two-component developer including toner and carrier is adopted as a developer. Hereinafter, the developer is referred to as "toner".

The image forming unit 14 includes a first path sensor 91A and a second path sensor 91B that detect passing of a sheet of recording paper P in a predetermined region of the transport path 30. In the image forming apparatus 10, various types of control (for example, control of the timing to perform transfer, timing to start/stop rotation of each roller, and timing to perform a fixing process) is performed on the basis of detection results generated by the first path sensor 91A and the second path sensor 91B.

Figure 2:
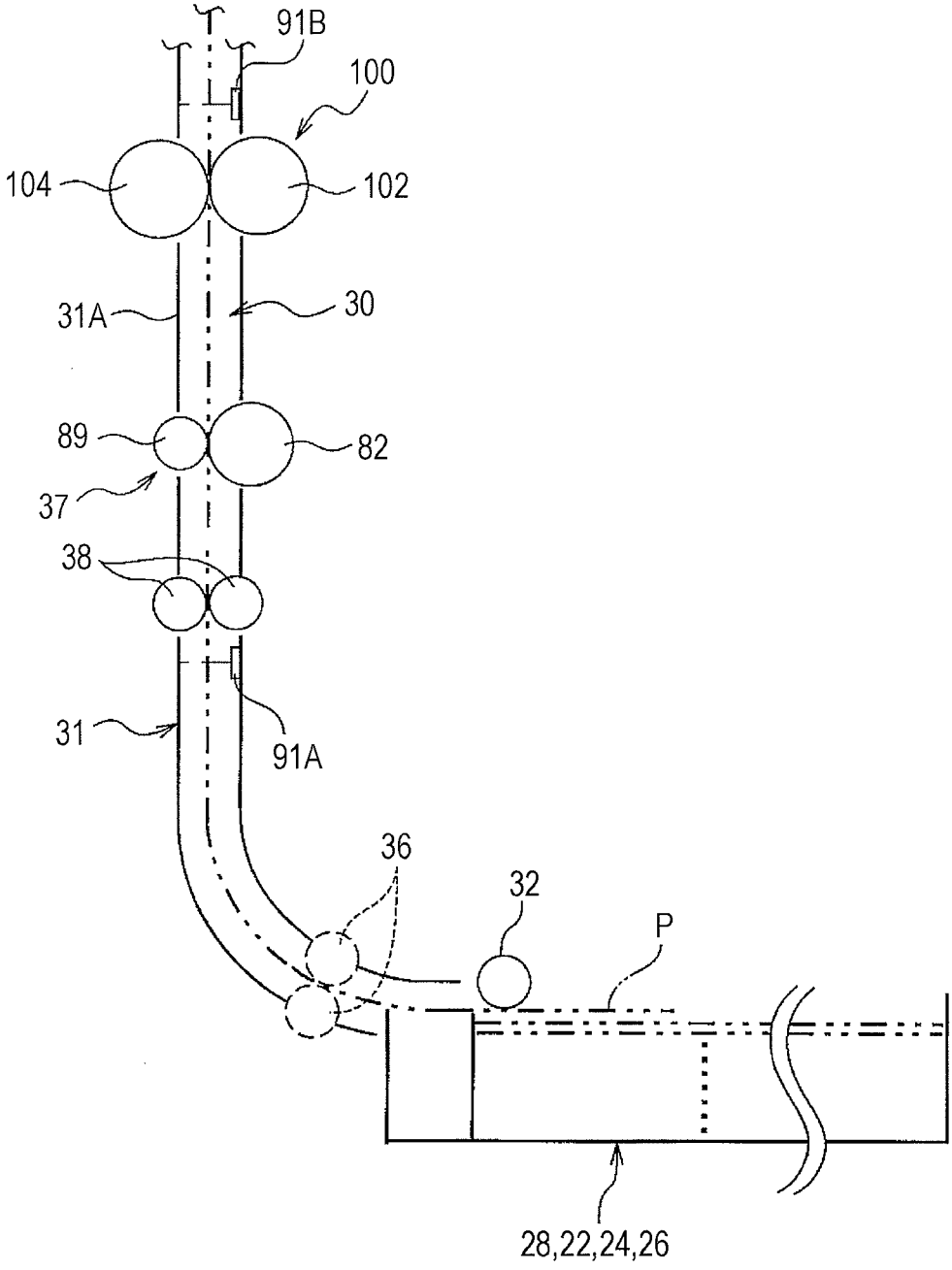
FIG. 2 is a schematic view illustrating an example of disposition of a first path sensor and a second path sensor according to the exemplary embodiment.

FIG. 2 schematically illustrates an example in which the first path sensor 91A and the second path sensor 91B according to the first exemplary embodiment are disposed along the transport path 30. As illustrated in FIG. 2, the pair of transport rollers 36, the pair of positioning rollers 38, the second transfer unit 37, and the fixing device 100 are disposed along the transport path 30 in this order from the upstream side toward the downstream side in the transport direction. The first path sensor 91A is disposed on the upstream side of the pair of positioning rollers 38 and on the downstream side of the pair of transport rollers 36 in the transport direction along the transport path 30. On the other hand, the second path sensor 91B is disposed on the downstream side of the fixing device 100 along the transport path 30. The first path sensor 91A and the second path sensor 91B are normally in an ON-state, and shift to an OFF-state while a sheet of recording paper P is passing through a detection target region. In other words, the first path sensor 91A and the second path sensor 91B are in an ON-state when no sheet of recording paper P exists in the detection target region (non-passing period of a sheet of recording paper P), and are in an OFF-state when a sheet of recording paper P exists in the detection target region (passing period of a sheet of recording paper P). A reflective photo interrupter is used for both the first path sensor 91A and second path sensor 91B according to the first exemplary embodiment. Alternatively, a transparent photo interrupter may be used therefor, and any types of sensor may be used as long as the sensor detects passing of a sheet of recording paper P (for example, a sensor that detects the leading end and the trailing end of a sheet of recording paper P).

Figure 3:
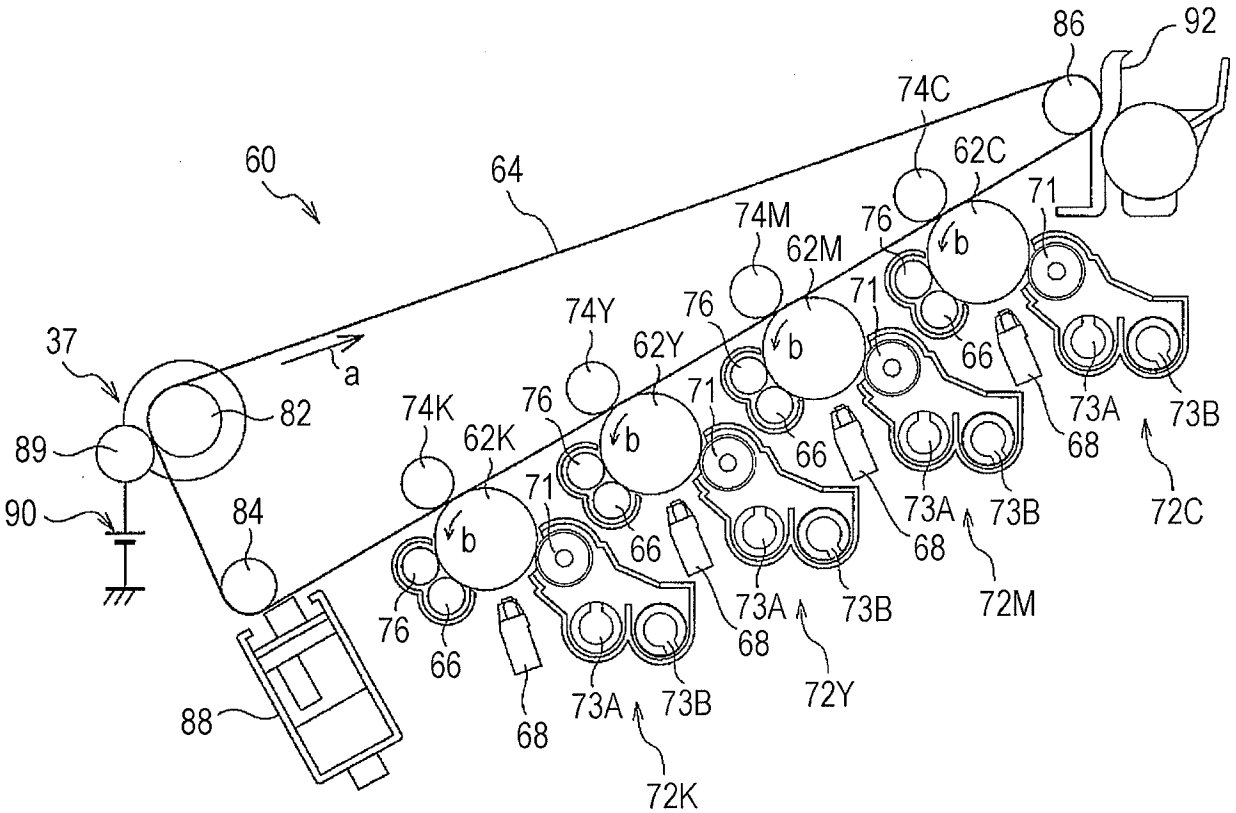
FIG. 3 is a diagram illustrating an example of a configuration of an image forming part according to the exemplary embodiment.

As illustrated in FIGS. 1 and 3, an image forming part 60 is provided at the center of the image forming unit 14. The image forming part 60 serves as a forming part for forming a toner image on a sheet of recording paper P by mixing toners of respective colors of black (K), yellow (Y), magenta (M), and cyan (C). The image forming part 60 includes photoconductor drums 62K, 62Y, 62M, and 62C for holding electrostatic latent images, which correspond to toners of respective colors of K, Y, M, and C. In the description given below, when it is necessary to distinguish K, Y, M, and C from one another, corresponding one of K, Y, M, and C will be attached after reference numeral. When it is not necessary to distinguish them, K, Y, M, and C will be omitted.

The photoconductor drums 62K, 62Y, 62M, and 62C are arranged in this order toward the upper right side in FIG. 3, are rotated in the direction indicated by an arrow b (counterclockwise in the figure), and hold an electrostatic latent image formed through irradiation on their peripheral surfaces. Also, a charging roller 66, a light-emitting diode (LED) head 68, a developing device 72, an intermediate transfer belt 64, and a cleaning roller 76 are provided in this order along the arrow-b direction around each of the photoconductor drums 62K, 62Y, 62M, and 62C.

The charging roller 66 has a configuration in which plural layers including an electro-conductive elastic layer, an intermediate layer, and a surface resin layer (not illustrated) are formed around a shaft made of stainless steel, for example. The shaft of the charging roller 66 is rotatable so that the charging roller 66 is rotated in conjunction with the photoconductor drum 62, with the peripheral surface of the charging roller 66 being in contact with the surface layer of the photoconductor drum 62. The charging roller 66 causes the peripheral surface of the photoconductor drum 62 to be charged through discharge that occurs when a voltage is applied from a voltage applying unit (not illustrated).

The LED head 68 causes the peripheral surface of the photoconductor drum 62 charged by the charging roller 66 to be irradiated with (exposed to) light corresponding to the color of toner, thereby forming an electrostatic latent image. Alternatively, a method for scanning laser light for four colors of K, Y, M, and C in common using a polygon mirror may be used as a method for exposing the photoconductor drums 62.

The developing device 72 includes a developing roller 71 that supplies toner to an electrostatic latent image formed on the photoconductor drum 62 and forms a toner image, and transport members 73A and 73B that transport toner to the developing roller 71 in a circulating manner.

The intermediate transfer belt 64 is an endless belt, is wound around a belt transport roller 82 provided in the second transfer unit 37, a belt transport roller 84 provided below and to the right of the belt transport roller 82, and a driving roller 86 that is provided above and to the right of the belt transport roller 82 and is driven by a motor (not illustrated), and is supported so as to be rotatably moved in the direction indicated by an arrow a (clockwise in the figure). The outer surface of the intermediate transfer belt 64 serves as a transfer surface onto which a toner image is to be transferred. The peripheral surfaces of the photoconductor drums 62K, 62Y, 62M, and 62C are in contact with a transfer surface of the intermediate transfer belt 64, the transfer surface extending from the driving roller 86 to the belt transport roller 84.

First transfer rollers 74 (74K, 74Y, 74M, and 74C) are provided on the opposite side to the photoconductor drums 62K, 62Y, 62M, and 62C, with the intermediate transfer belt 64 interposed therebetween. The first transfer rollers 74 are in contact with the inner surface of the intermediate transfer belt 64. When a voltage is applied to the first transfer rollers 74 from a voltage applying unit (not illustrated), the first transfer rollers 74 perform first transfer, thereby transferring the toner images on the photoconductor drums 62 onto the transfer surface of the intermediate transfer belt 64 using a potential difference between the first transfer rollers 74 and the photoconductor drums 62 that are grounded. Accordingly, the individual toner images are transferred onto the intermediate transfer belt 64 in a superimposed manner while the intermediate transfer belt 64 makes a round.

Also, a toner density detection sensor 88 is provided on the opposite side to the belt transport roller 84, with the intermediate transfer belt 64 interposed therebetween. The tonner density detection sensor 88 has a function of detecting the density of a toner image transferred onto the transfer surface of the intermediate transfer belt 64. Furthermore, a cleaning member 92 is provided on the opposite side to the driving roller 86, with the intermediate transfer belt 64 interposed therebetween. The cleaning member 92 removes residual toner that is left on the transfer surface of the intermediate transfer belt 64 after second transfer.

The second transfer unit 37 includes the belt transport roller 82 on which the intermediate transfer belt 64 is wound, and a second transfer roller 89. The second transfer roller 89 serves as a transport unit and is provided on the opposite side to the belt transport roller 82, with the intermediate transfer belt 64 interposed therebetween. The second transfer roller 89 is connected to a voltage applying unit 90 so that a voltage is applied thereto from the voltage applying unit 90, and is configured so that the toner image on the intermediate transfer belt 64 is second transferred onto a sheet of recording paper P due to a potential difference between the belt transport roller 82 and the second transfer roller 89.

As illustrated in FIG. 1, toner cartridges 77K, 77Y, 77M, and 77C containing toners of K, Y, M, and C, respectively, are provided in an exchangeable manner to the right of the cleaning member 92 in the image forming unit 14. Also, a duplex-printing transport path 94 is provided to the left of the transport path 30 in the image forming unit 14. In the duplex-printing transport path 94, a sheet of recording paper P is transported and reversed so as to form images on both sides of the sheet.

One end of the duplex-printing transport path 94 is connected between a pair of transport rollers 95 and a pair of transport rollers 96. The pair of transport rollers 95 is provided on the downstream side of the fixing device 100 in the transport direction of a sheet of recording paper P along the transport path 30. The pair of transport rollers 96 is provided on the downstream side of the pair of transport rollers 95, and the rotation direction thereof may be switched. The other end of the duplex-printing transport path 94 is connected to the upstream side of the pair of positioning rollers 38. Also, the duplex-printing transport path 94 is provided with plural transport rollers 97 that transport a sheet of recording paper P fed from the pair of transport rollers 96 toward the pair of positioning rollers 38. Accordingly, when images are to be formed on both sides, a sheet of recording paper P to which a toner image has been fixed onto the front side by the fixing device 100 is fed to the duplex-printing transport path 94 due to a reverse rotation of the pair of transport rollers 96 and a path switching member (not illustrated), and is fed again to the pair of positioning rollers 38, so that the front and back sides of the sheet of recording paper P are reversed.

Lower output rollers 54 are provided on the downstream side of the pair of transport rollers 95 in the output unit 16. The lower output rollers 54 are disposed along a transport path 33, which branches off from the transport path 30 to the output region 19 side, and output a sheet of recording paper P onto a lower table 52 provided in an upper section of the image forming unit 14. A lower detecting unit 55 is provided at a position next to the lower output rollers 54. The lower detecting unit 55 detects the height of sheets of recording paper P stacked on the lower table 52. Also, upper output rollers 57 are provided on the downstream side of the pair of transport rollers 95 along the transport path 30 in the output unit 16. The upper output rollers 57 output sheets of recording paper P onto an upper table 56, which is provided above the lower table 52. An upper detecting unit 58 is provided at a position next to the upper output rollers 57. The upper detecting unit 58 detects the height of sheets of recording paper P stacked on the upper table 56.

The document reader 18 includes a document transport device 45 that automatically transports sheets of a document G one by one, a platen glass 47 which is disposed below the document transport device 45 and on which one sheet of the document G is placed, and a document reading device 49 that reads the document G transported by the document transport device 45 or the document G placed on the platen glass 47. The document transport device 45 includes an automatic transport path 48 along which plural pairs of transport rollers 46 are disposed. Part of the automatic transport path 48 is disposed so that a sheet of recording paper P passes over the platen glass 47. The document reading device 49 is configured to read a document G that is transported by the document transport device 45 in the state of being stationary at the left end of the platen glass 47, or to read a document G placed on the platen glass 47 while moving in the X direction.

Figure 4:
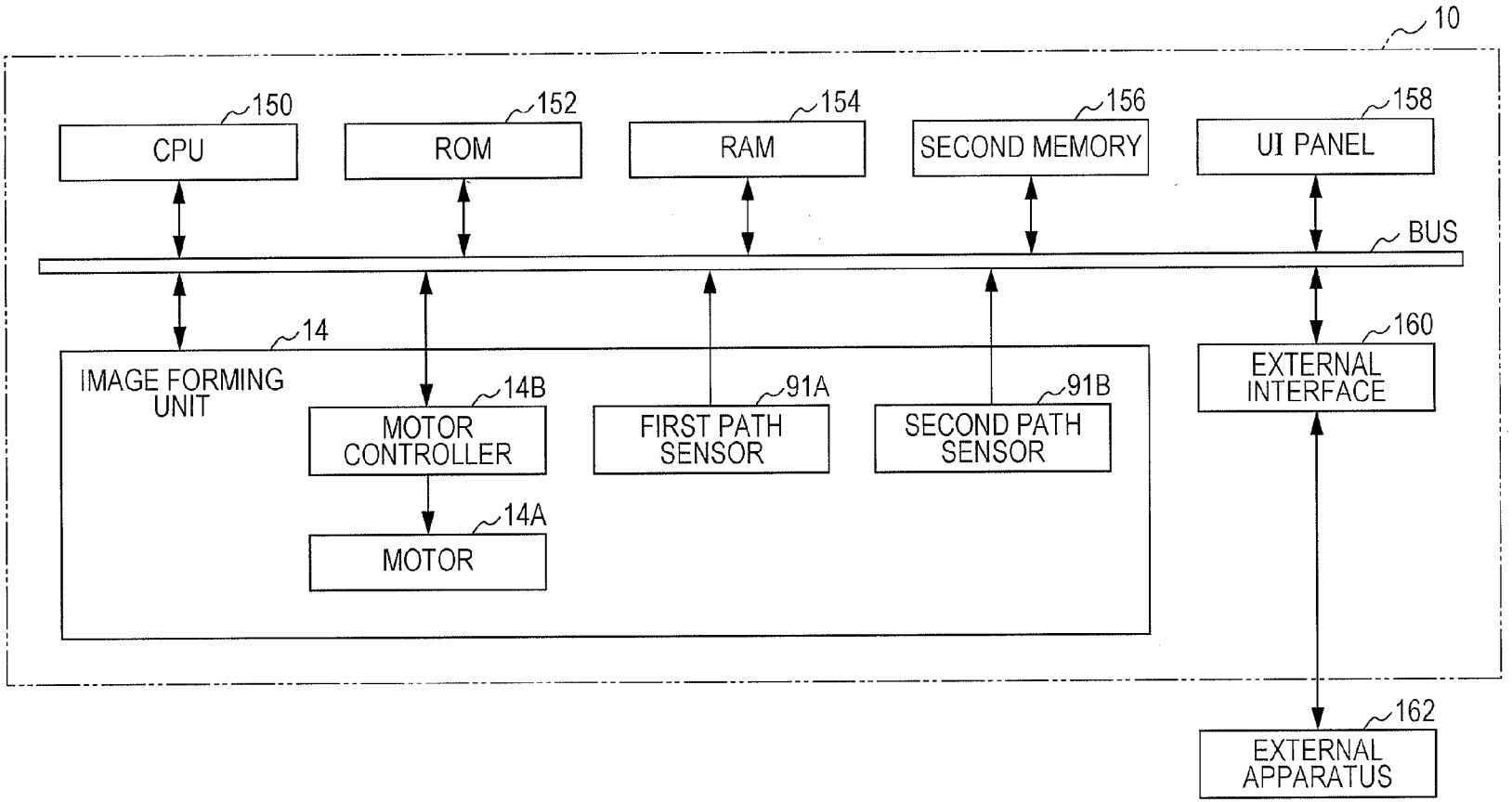
FIG. 4 is a block diagram illustrating a configuration of an electric system of the image forming apparatus according to the exemplary embodiment.

FIG. 4 is a block diagram illustrating a configuration of an electric system of the image forming apparatus 10 according to this exemplary embodiment. As illustrated in FIG. 4, the image forming apparatus 10 includes a central processing unit (CPU) 150 serving as an estimating unit and a controller, a read only memory (ROM) 152, a random access memory (RAM) 154, a second memory 156, a user interface (UI) panel 158, and an external interface 160.

The ROM 152 functions as a memory that stores in advance a control program for controlling the operation of the image forming apparatus 10, a sheet length identification process program described below, and various parameters. The RAM 154 is used as a working area or the like for executing various programs. The second memory 156 stores various pieces of information that are to be held even after the power switch of the apparatus is turned off. For example, a hard disk device or a flash memory is applied thereto. The UI panel 158 is constituted by a touch panel display or the like in which a transparent touch panel is superimposed on a display. Various pieces of information are displayed on the display screen of the display. Also, the UI panel 158 receives various pieces of information and instructions when the touch panel is touched by a user. The external interface 160 is connected to the external apparatus 162, such as a personal computer, receives various pieces of information, such as image information representing an image that is to be formed on recording paper P, from the external apparatus 162, and transmits various pieces of information, such as information representing the status of the image forming apparatus 10, to the external apparatus 162.

The image forming unit 14, the CPU 150, the ROM 152, the RAM 154, the second memory 156, the UI panel 158, and the external interface 160 are connected to one another via a system bus BUS. Thus, the CPU 150 accesses the ROM 152, the RAM 154, and the second memory 156, displays various pieces of information on the UI panel 158, recognizes operation instructions provided by a user to the UI panel 158, receives various pieces of information from the external apparatus 162 via the external interface 160, transmits various pieces of information to the external apparatus 162 via the external interface 160, recognizes the operation status of the image forming unit 14, and controls the operation of the image forming unit 14.

The image forming unit 14 serving as an image forming unit includes, for example, the motor 14A that generates a driving force for rotating various rollers for transporting a sheet of recording paper P, such as the feed rollers 32 serving as a feed unit, the pairs of transport rollers 36 serving as a supplying unit, the pairs of transport rollers 44, 54, 57, 95, and 96 serving as a transport unit, the pair of positioning rollers 38 serving as a transport unit, the fixing roller 102 serving as a transport unit, and the pressure roller 104 serving as a transport unit. Also, the image forming unit 14 includes a motor controller 14B that is connected to the motor 14A and controls driving of the motor 14A, the first path sensor 91A serving as a detecting unit, and the second path sensor 91B serving as a detecting unit. The motor controller 14B, the first path sensor 91A, and the second path sensor 91B are connected to one another via the system bus BUS. Thus, the CPU 150 controls the motor 14A via the motor controller 14B, recognizes the operation status of the motor 14A via the motor controller 14B, and receives signals output from the first path sensor 91A and the second path sensor 91B (ON signal representing an ON state and OFF signal representing an OFF state).

The image forming apparatus 10 according to the first exemplary embodiment has an assist function of assisting transport of a sheet of recording paper P by using the feed roller 32 in a case where the length in the transport direction of the sheet to be transported (hereinafter referred to as "sheet length") is equal to or larger than a predetermined length (for example, the length in the longitudinal direction of the A4 size).

The assist function is a function of assisting transport of a sheet of recording paper P while the sheet is being transported along the transport path 30 in order to suppress the occurrence of wrinkling or slipping of the sheet during transport. It is necessary that the following three conditions (i) to (iii) are satisfied in order to operate the assist function (hereinafter the three conditions are referred to as "assist function operation conditions").

(i) A sheet length equal to or larger than a predetermined length is set.

(ii) The leading end of a sheet of recording paper P is in contact with the pair of positioning rollers 38 the rotation of which is stopped.

(iii) The rotation of the feed roller 32 is stopped.

When the assist function operation conditions are satisfied, the assist function simultaneously starts the rotation of the pair of positioning rollers 38 and the feed roller 32 that are temporarily stopped, and continues the rotation of the feed roller 32 until a predetermined stop condition is satisfied (for example, a predetermined time period has elapsed as a time period for assisting transport of a sheet of recording paper P having a sheet length set by a user after the rotation of the pair of positioning rollers 38 and the feed roller 32 that are temporarily stopped has simultaneously started (after feeding to the downstream side of the pair of positioning rollers 38 has started)). The predetermined stop condition is a predetermined condition for determining that the trailing end of a sheet of recording paper P has passed the feed roller 32, for example, a condition in which a predetermined time period (for example, 0.8 seconds) has elapsed from restart of transport of the sheet.

If the condition "a sheet length smaller than a predetermined length is set" is satisfied instead of condition (i), the assist function is not operated, and a normal transport operation is performed. Here, the "normal transport operation" means transporting a sheet of recording paper P by rotating the pair of positioning rollers 38 and the individual rollers disposed along the transport path 30, not by rotating the feed roller 32. In the image forming apparatus 10 according to the first exemplary embodiment, "setting of a sheet length" means determining a sheet length on the basis of the position of a side fence (not illustrated) provided in the accommodating unit that accommodates sheets of recording paper P as a target to be transported (target on which an image is to be formed) and that is specified via the UI panel 158, and storing the determined sheet length in a predetermined storage region. Here, the "side fence" is a fence for specifying the length of sheets of recording paper P accommodated in the accommodating unit. The position of the side fence in the accommodating unit may be detected by using a sensor, such as a photo interrupter or a micro switch.

In the image forming apparatus 10 according to the first exemplary embodiment, a side fence is provided in each accommodating unit, but the side fence may not be provided in each accommodating unit. In that case, "setting of a sheet length" means providing accommodating units corresponding to individual sheet lengths of recording paper P, specifying any one of the accommodating units via the UI panel 158, and storing the sheet length corresponding to the specified accommodating unit in a predetermined storage region.

Next, the operation of the image forming apparatus 10 according to this exemplary embodiment will be described.

First, an image formation process performed by the image forming apparatus 10 will be described.

After the image forming apparatus 10 has been activated, image data of individual colors of K, Y, M, and C is output from an image processing apparatus (not illustrated) or the outside to the corresponding LED heads 68 (see FIG. 3). Subsequently, light is emitted from the LED heads 68 in accordance with the image data, the peripheral surfaces of the photoconductor drums 62 charged by the charging rollers 66 are exposed to the light, and electrostatic latent images corresponding to the image data of the respective colors are formed on the surfaces of the respective photoconductor drums 62. The electrostatic latent images formed on the surfaces of the respective photoconductor drums 62 are developed into toner images by the respective developing devices 72. Then, the toner images on the surfaces of the respective photoconductor drums 62 are sequentially transferred onto the intermediate transfer belt 64 by the first transfer rollers 74.

On the other hand, a sheet of recording paper P that is fed from the sheet accommodating unit 12 and is transported along the transport path 30 is transported by the pair of positioning rollers 38 to the second transfer unit 37 in synchronization with the transfer of the individual toner images onto the intermediate transfer belt 64. The toner images that have been transferred onto the intermediate transfer belt 64 are second transferred by the second transfer roller 89 onto the sheet of recording paper P transported to the second transfer unit 37.

Subsequently, the sheet of recording paper P onto which the toner images have been transferred is transported to the fixing device 100. In the fixing device 100, the toner images are heated and pressed by the fixing roller 102 and the pressure roller 104, thereby being fixed onto the sheet of recording paper P. Furthermore, the sheet of recording paper P onto which the toner images have been fixed is output from the output unit 16 to the lower table 52 or the upper table 56. In the case of forming images on both sides of the sheet of recording paper P, an image is fixed onto the front surface of the sheet by the fixing device 100, and the trailing end of the sheet is fed from the pair of transport rollers 96 to the duplex-printing transport path 94 and to the pair of positioning rollers 38 (transport path 30), so that the leading end and the trailing end of the sheet are changed. Then, an image is formed on and fixed onto the rear surface of the sheet.

In the image forming apparatus 10 according to the first exemplary embodiment, the length of a sheet of recording paper P to be transported is set by a user, as described above. Also, in the image forming apparatus 10, an image is formed on the sheet of recording paper P accommodated in the accommodating unit corresponding to the set sheet length. However, if sheets of recording paper P having a sheet length not intended by the user are accommodated in the accommodating unit, an image formation process is performed on a sheet of recording paper P having a sheet length different from the sheet length set by the user. For example, if the length of a sheet of recording paper P that is being transported is smaller than the sheet length set by the user, toner may be applied to a region where no sheet exists, so that the inside of the image forming unit 14 may become dirty unnecessarily. In order to avoid the occurrence of such a situation, passing of a sheet of recording paper P may be detected at the inlet of the transport path 30 to measure the sheet length, and it may be determined whether or not the sheet length is a sheet length intended by the user. Accordingly, the occurrence of a situation in which an image formation process is performed on a sheet of recoding paper P having an unintended sheet length is prevented. However, for example, if sheets of recording paper P are not fed one by one by the feed roller 32, a sheet of recording paper P may be fed to the transport path 30 in the state of being partially overlapped on the preceding sheet. The cause of such overlap may be, for example, burrs caused by punching a hole in the recording paper P using a puncher, static electricity on the recording paper P, or an adhesive (for example, glue) that is adhered to the recording paper P in an unintended manner. If a sheet of recording paper P is transported in the state of being partially overlapped on the subsequent sheet due to such a cause, a wrong determination may be made in which a sheet of recording paper P having a length intended by the user (sheet length set by the user) is being transported, although the sheet length is actually different from that intended by the user. Also, another wrong determination may be made in which a sheet of recording paper P having a length intended by the user is not being transported, although the sheet length is actually the sheet length intended by the user.

Accordingly, in the image forming apparatus 10 according to this exemplary embodiment, a sheet length identification process is performed in which it is identified with high accuracy whether or not the length of a sheet of recording paper P that is currently being transported is a sheet length set by a user.

Figure 5A:
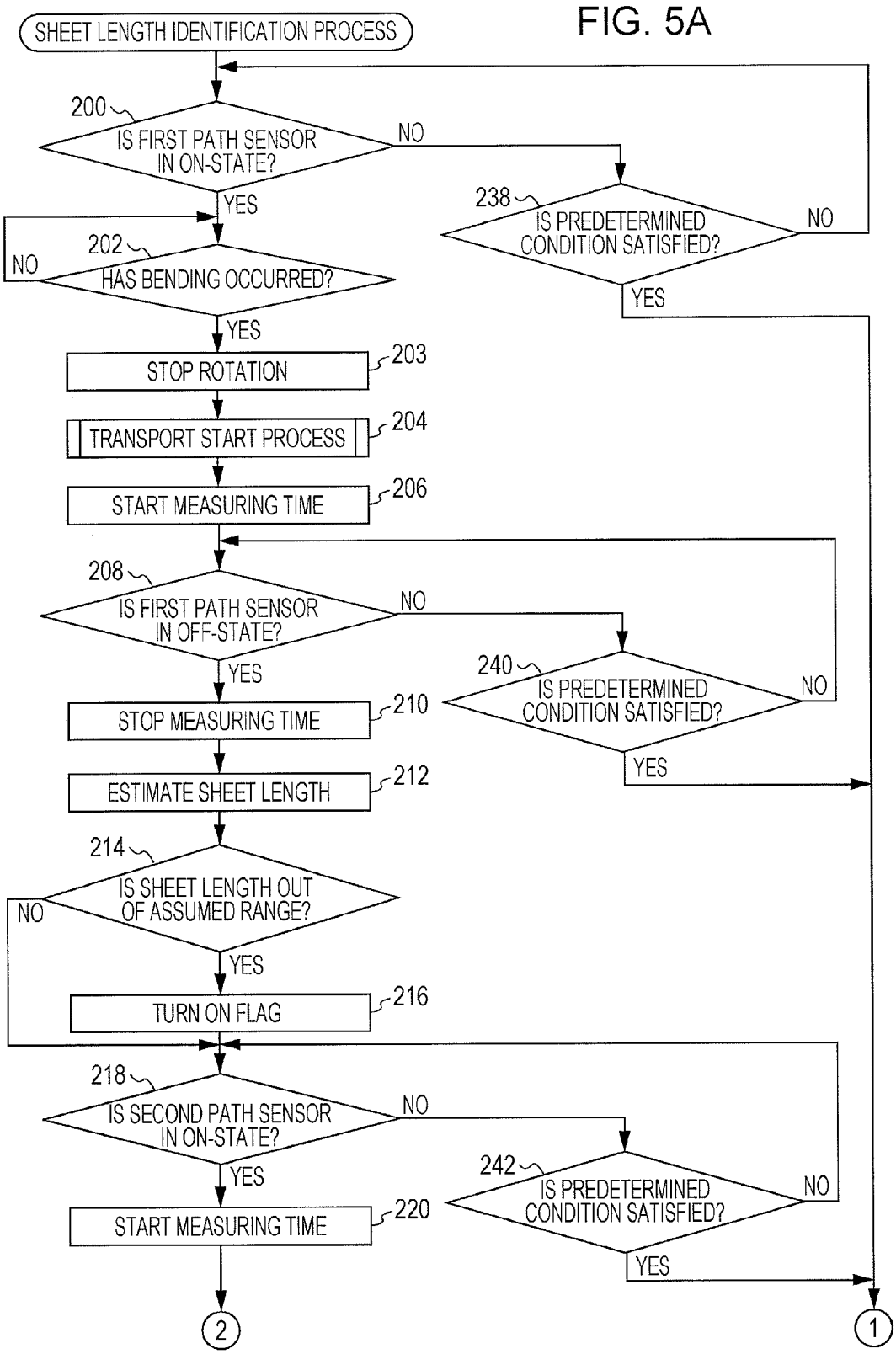
FIGS. 5A and 5B illustrate a flowchart of a process of a sheet length identification process program according to a first exemplary embodiment of the present invention.
Figure 5B:
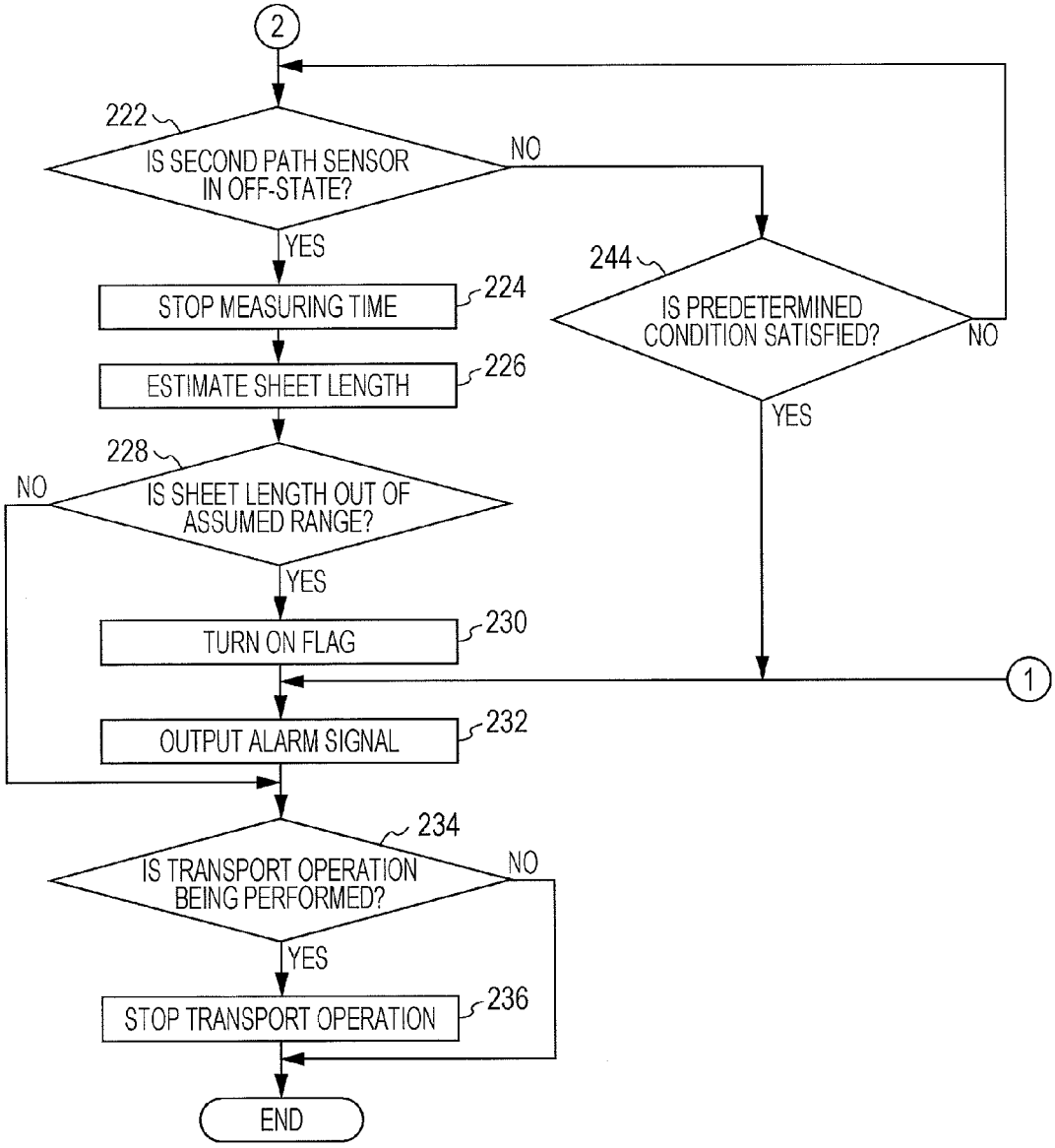

Hereinafter, the operation of the image forming apparatus 10 during the execution of the sheet length identification process will be described with reference to FIGS. 5A and 5B. FIGS. 5A and 5B illustrate a flowchart of an example of a process of a sheet length identification process program executed by the CPU 150 when the rotation of the feed roller 32 corresponding to the fourth accommodating unit 28 is started in order to take a sheet of recording paper P accommodated in the fourth accommodating unit 28 and to feed the sheet to the branch chute $\mathbf{31}B_4$. The sheet length identification process program is stored in advance in a predetermined storage region of the ROM 152. Here, in order to avoid complexity, a description will be given of a case where the sheet length identification process program is executed in a state where the rotation of the pair of positioning rollers 38 and the rollers disposed along the transport path 30 is stopped.

Referring to FIGS. 5A and 5B, in step 200, it is determined whether or not the first path sensor 91A has shifted from an OFF-state to an ON-state. If a positive determination is made, the process proceeds to step 202. If a negative determination is made, the process proceeds to step 238. In step 238, it is determined whether or not a predetermined condition is satisfied. The predetermined condition is a condition for determining that a sheet of recording paper P having a predetermined sheet length is not being transported (for example, one second has passed from the start of the execution of step 200). If a negative determination is made, the process returns to step 200. If a positive determination is made, the process proceeds to step 232.

In step 202, the process waits until the leading end of a sheet of recording paper P fed to the chute 31 by the feed roller 32 comes into contact with the pair of positioning rollers 38 and the sheet forms bending of a predetermined degree (bending for correcting skew), that is, until 0.5 seconds have elapsed from the start of the rotation of the feed roller 32. Then, the process proceeds to step 203, where the rotation of the feed roller 32 is stopped, and the process proceeds to step 204.

Figure 6:
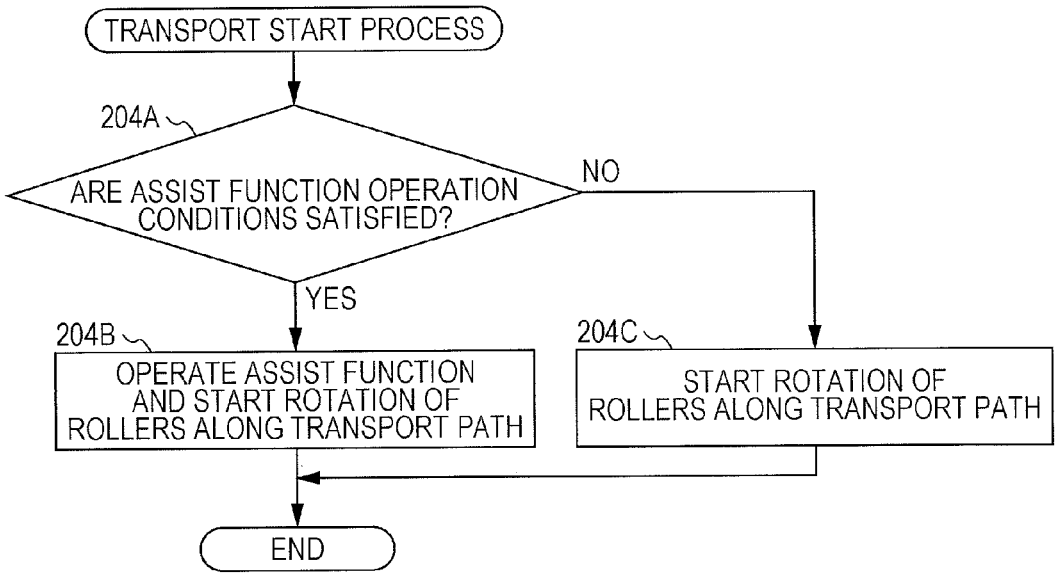
FIG. 6 is a flowchart illustrating a process of a transport start process program according to the first exemplary embodiment.

In step 204, a transport start process is performed. Now, the operation of the image forming apparatus 10 during the execution of the transport start process will be described with reference to FIG. 6. FIG. 6 is a flowchart illustrating an example of the process of a transport start process program executed by the CPU 150. The transport start process program is stored in advance in a predetermined storage region of the ROM 152.

In step 204A in FIG. 6, it is determined whether or not the assist function operation conditions are satisfied. If a positive determination is made, the process proceeds to step 204B. If a negative determination is made, the process proceeds to step 204C. In step 204B, the assist function is operated, and the rotation of the rollers disposed along the transport path 30 is started. Then, the transport start process program is ended, and the process proceeds to step 206 of the sheet length identification process program. On the other hand, in step 204C, the rotation of the individual rollers disposed along the transport path 30 is started, thereby starting transport of a sheet of recording paper P. Then, the transport start process program is ended, and the process proceeds to step 206 of the sheet length identification process program.

In step 206 in FIG. 5A, measuring the time is started. Then, the process proceeds to step 208, where it is determined whether or not the first path sensor 91A has shifted from the ON-state to the OFF-state. If a positive determination is made, the process proceeds to step 210. If a negative determination is made, the process proceeds to step 240. In step 240, it is determined whether or not a predetermined condition is satisfied. The predetermined condition is a condition for determining that a sheet of recording paper P having a predetermined sheet length is not being transported (for example, one second has passed from the start of measurement of the time in step 206). If a negative determination is made, the process returns to step 208. If a positive determination is made, the process proceeds to step 232.

In step 210, the measurement of the time started in step 206 is stopped. In step 212, the length of the sheet of recording paper P that is currently being transported is estimated on the basis of the time measured in steps 206 and 210, and then the process proceeds to step 214. In step 212, the sheet length is estimated by using the following equation (1). Alternatively, the sheet length may be estimated by obtaining the sheet length by using a look-up table to which the time measured in steps 206 and 210 is input and from which the sheet length is output.

$$\text{Sheet length (mm)} = V \times (T1 - \alpha) + A \quad (1)$$

Here, T1 (sec) represents the time measured (the elapsed time from step 206 to step 210), V (mm/sec) represents the transport speed of a sheet of recording paper P, A (mm) represents the distance from a position of the pair of positioning rollers 38 where the leading end of a sheet of recording paper P comes into contact (nip portion) to a detection position of the first path sensor 91A, and a (sec) represents a waiting time until transport restarts (for example, the sum of a time period in which the rotation of the feed roller 32 temporarily stops, and a time period from when an instruction to operate the pair of positioning rollers 38 is provided to when the pair of positioning rollers 38 are actually operated).

In step 214, it is determined whether or not the sheet length estimated in step 212 is out of an assumed range. If a positive determination is made, the process proceeds to step 216, where a flag indicating that the length of the sheet of recording paper P that is currently being transported is out of the assumed range is set (to an ON-state), and the process proceeds to step 218. If a negative determination is made in step 214, step 216 is skipped and the process proceeds to step 218. Here, the "length out of the assumed range" is determined in view of an error of ±1 mm if the size of a sheet of recording paper P specified as a target to be transported is A3SEF, for example.

In step 218, it is determined whether or not the second path sensor 91B has shifted from the OFF-state to the ON-state. If a positive determination is made, the process proceeds to step 220. If a negative determination is made, the process proceeds to step 242. In step 242, it is determined whether or not a predetermined condition is satisfied. The predetermined condition is a condition for determining that a sheet of recording paper P having a predetermined sheet length is not being transported (for example, 0.5 seconds have passed since the second path sensor 91B shifted from the ON-state to the OFF-state). If a negative determination is made, the process returns to step 218. If a positive determination is made, the process proceeds to step 232.

In step 220, measurement of time is started. Then, the process proceeds to step 222, where it is determined whether or not the second path sensor 91B has shifted from the ON-state to the OFF-state. If a positive determination is made, the process proceeds to step 224. If a negative determination is made, the process proceeds to step 244. In step 244, it is determined whether or not a predetermined condition is satisfied. The predetermined condition is a condition for determining that a sheet of recording paper P having a predetermined sheet length is not being transported (for example, one second has passed from the start of measurement of time in step 220). If a negative determination is made, the process returns to step 222. If a positive determination is made, the process proceeds to step 232.

In step 224, the measurement of time started in step 220 is stopped. In step 226, the length of the sheet of recording paper P that is currently being transported is estimated on the basis of the measured time, and the process proceeds to step 228.

In step 228, it is determined whether or not the sheet length estimated in step 226 is out of the assumed range. If a positive determination is made, the process proceeds to step 230, where a flag indicating that the length of the sheet of recording paper P that is currently being transported is out of the assumed range is set (to an ON-state), and then the process proceeds to step 232.

In step 232, an alarm signal indicating that the length of the sheet of recording paper P that is currently being transported is out of the assumed range is output, and then the process proceeds to step 234. The alarm signal is output to the UI panel 158, for example. When receiving the alarm signal, the UI panel 158 displays a message indicating that the length of the sheet of recording paper P that is currently being transported is out of the assumed range. An example of the message may be "The set sheets have a size different from the specified size.", "The specified sheet is not being transported.", or "Please set the sheet size again." Instead of displaying a visible message on the UI panel 158, an audible message may be output from a speaker, or a message may be printed on paper so that the message may be permanently visible. Alternatively, some of display of a visible message, output of an audible message, and permanent display of a message may be used together. Alternatively, an alarm signal may be transmitted to the external apparatus 162 via the external interface 160.

If a negative determination is made in step 228, steps 230 and 232 are skipped, and the process proceeds to step 234. In step 234, it is determined whether or not there is a roller that is rotating among the feed roller 32 and the rollers disposed along the transport path 30. If a negative determination is made, the sheet length identification process program ends. If a positive determination is made, the process proceeds to step 236, where the rotation of rollers is stopped to stop the transport operation, and then the sheet length identification process program ends.

As described above in detail, in the image forming apparatus 10 according to the first exemplary embodiment, the length of a sheet of recording paper P is estimated on the basis of individual detection results generated by the respective first path sensor 91A and second path sensor 91B disposed along the transport path 30, and an alarm signal is output if the sheet length estimated on the basis of at least one of the detection results is not a predetermined length. Accordingly, whether or not the length of the transported sheet of recording paper P is the predetermined length is identified with high accuracy, compared to a case where the image forming apparatus 10 does not have the above-described configuration.

Second Exemplary Embodiment

In the first exemplary embodiment, a description has been given of the sheet length identification process in a case where a sheet of recording paper P accommodated in the fourth accommodating unit 28 is taken from the fourth accommodating unit 28 and is fed to the transport path 30. In a second exemplary embodiment, a description will be given of a case where any one of the first to fourth accommodating units 22, 24, 26, and 28 is specified, and a sheet of recording paper P is taken by the feed roller 32 from the specified accommodating unit and is fed to the transport path 30. The elements described above in the first exemplary embodiment are denoted by the same reference numerals, and the corresponding description will be omitted. Hereinafter, the points different from the first exemplary embodiment will be described.

In the image forming apparatus 10 according to the second exemplary embodiment, a sheet of recording paper P that is taken by the feed roller 32 from an accommodating unit and is fed to the transport path 30 may be fed while being overlapped on the subsequent sheet of recording paper P due to burrs or static electricity, for example. However, in the image forming apparatus 10 according to the second exemplary embodiment, the pairs of transport rollers 36 are provided for the respective first to third accommodating units 22, 24, and 26. Thus, even if a sheet of recording paper P is taken by the feed roller 32 from any one of the first to third accommodating units 22, 24, and 26 and is fed to the transport path 30 while being overlapped on the subsequent sheet of recording paper P, the overlapped sheet may be separated by the pair of transport rollers 36. Accordingly, a sheet of recording paper P that is taken by the feed roller 32 from any one of the first to third accommodating units 22, 24, and 26 and is fed to the transport path 30 is less likely to be transported while being overlapped on the subsequent sheet of recording paper P, compared to a sheet of recording paper P that is taken by the feed roller 32 from the fourth accommodating unit 28 and is fed to the transport path 30.

As described above, if there is a path along which a sheet is less likely to be transported while being overlapped on another sheet, a sufficient accuracy of identifying each sheet of recording paper P is ensured for the sheets of recording paper P that are transported along the path, even if an estimation result of a sheet length obtained on the basis of the detection results generated by the first and second path sensors 91A and 91B is not used, unlike in the above-described first exemplary embodiment.

In the image forming apparatus 10 according to the second exemplary embodiment, a sheet length identification process according to an accommodating unit is performed, in which either of two estimation methods is used. One of the two estimation methods is a method for estimating the length of a sheet of recording paper P that is taken by the feed roller 32 from any one of the first to third accommodating units 22, 24, and 26 and is fed to the transport path 30. The other is a method for estimating the length of a sheet of recording paper P that is taken by the feed roller 32 from the fourth accommodating unit 28 and is fed to the transport path 30.

Figure 7A:
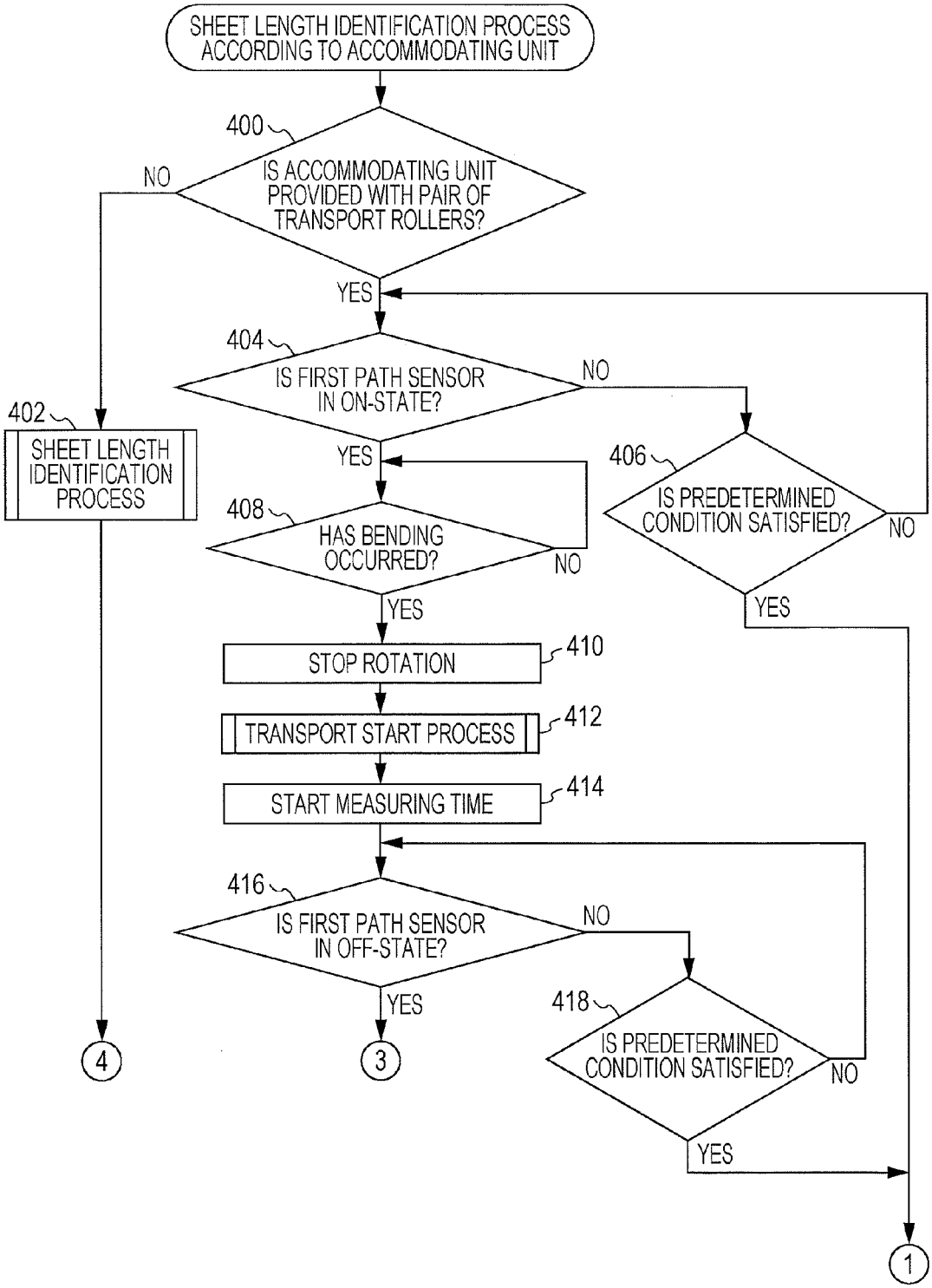
FIGS. 7A and 7B illustrate a flowchart of a process of a sheet length identification process program according to an accommodating unit according to a second exemplary embodiment of the present invention.
Figure 7B:
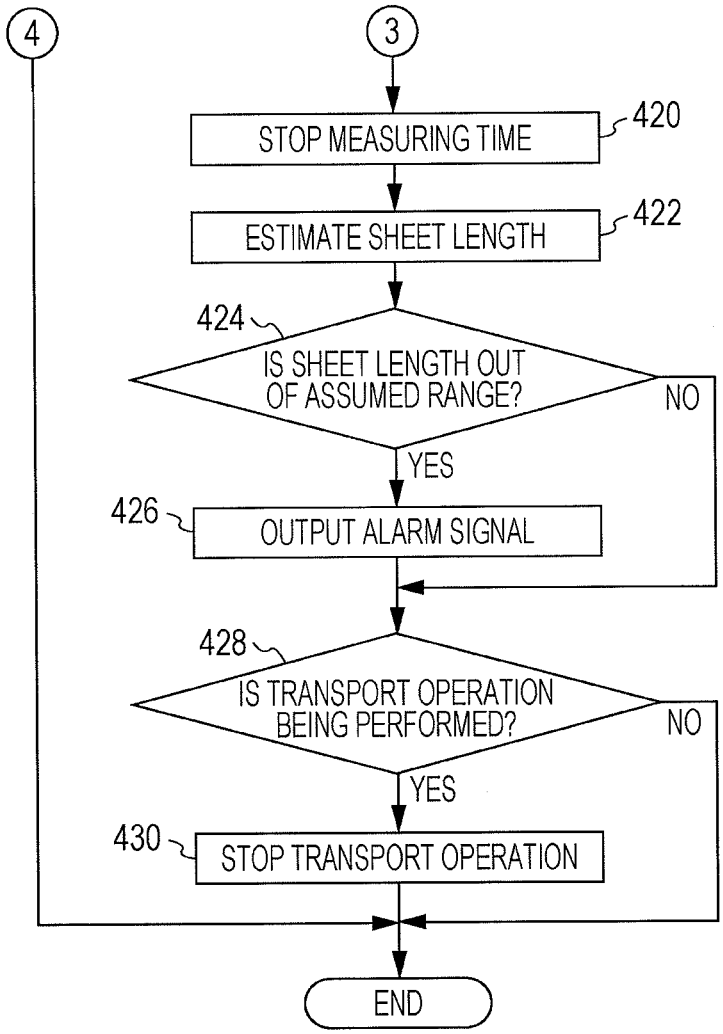

Hereinafter, the operation of the image forming apparatus 10 during the execution of the sheet length identification process according to an accommodating unit will be described with reference to FIGS. 7A and 7B. FIGS. 7A and 7B illustrate a flowchart of an example of a process of a sheet length identification process program according to an accommodating unit executed by the CPU 150 when the rotation of the feed roller 32 corresponding to a specified accommodating unit is started in order to take a sheet of recording paper P accommodated in the specified accommodating unit and feed the sheet to the transport path 30. The sheet length identification process program according to an accommodating unit is stored in advance in a predetermined storage region of the ROM 152. Here, in order to avoid complexity, a description will be given of a case where any one of the first to fourth accommodating units 22, 24, 26, and 28 is already specified as an accommodating unit that accommodates sheets of recording paper P to be transported. Also, a description will be given of a case where the sheet length identification process program according to an accommodating unit is executed in a state where the rotation of the pair of positioning rollers 38 and the rollers disposed along the transport path 30 is stopped.

Referring to FIGS. 7A and 7B, in step 400, it is determined whether or not the accommodating unit that is currently specified is provided with the pair of transport rollers 36 corresponding thereto. If a negative determination is made, the process proceeds to step 402, where the sheet length identification process program described above in the first exemplary embodiment is executed, and the sheet length identification process program according to an accommodating unit ends.

On the other hand, if a positive determination is made in step 400, the process proceeds to step 404. In step 404, a step corresponding to the above-described step 200 is performed. If a negative determination is made in step 404, the process proceeds to step 406, a step corresponding to the above-described step 238 is performed. If a positive determination is made in step 404, the process proceeds to step 408. In step 408, a step corresponding to the above-described step 202 is performed, and then the process proceeds to step 410. In step 410, a step corresponding to the above-described step 203 is performed, and then the process proceeds to step 412. In step 412, a step corresponding to the above-described step 204 is performed, and then the process proceeds to step 414. In step 414, a step corresponding to the above-described step 206 is performed, and then the process proceeds to step 416. In step 416, a step corresponding to the above-described step 208 is performed. If a negative determination is made in step 416, the process proceeds to step 418, where a step corresponding to the above-described step 240 is performed.

On the other hand, if a positive determination is made in step 416, the process proceeds to step 420, where a step corresponding to the above-described step 210 is performed, and then the process proceeds to step 422. In step 422, a step corresponding to the above-described step 212 is performed, and then the process proceeds to step 424. In step 424, it is determined whether or not the sheet length estimated in step 422 is out of an assumed range. If a positive determination is made, the process proceeds to step 426. In step 426, a step corresponding to the above-described step 232 is performed, and then the process proceeds to step 428.

On the other hand, if a negative determination is made in step 424, the process proceeds to step 428. In step 428, a step corresponding to the above-described step 234 is performed, and then the process proceeds to step 430. In step 430, a step corresponding to the above-described step 236 is performed, and then the sheet length identification process program according to an accommodating unit ends.

As a result of executing the sheet length identification process according to an accommodating unit, a sheet length is estimated with high accuracy when a sheet of recording paper P is taken from any one of the accommodating units and is fed to the transport path 30. Also, as for a sheet of recording paper P that is taken from any one of the first to third accommodating units 22, 24, and 26 and is fed to the transport path 30, the sheet length thereof is estimated on the basis of a detection result generated by the first path sensor 91A, not on the basis of a detection result generated by the second path sensor 91B. Thus, the load of estimation is decreased compared to the case of estimating the sheet length using the detection results generated by both the first and second path sensors 91A and 91B. Also, the time for estimation is shortened.

In the image forming apparatus 10 according to the second exemplary embodiment, when the assist function operation conditions are satisfied, the assist function operates even though a sheet length specified as the length of sheets of recording paper P to be transported is equal to or larger than a predetermined sheet length and even though sheets of recording paper P having a length shorter than the specified sheet length are accommodated in the accommodating unit that is to accommodate sheets of recording paper P of the specified sheet length. However, in a path provided with the pair of transport rollers 36, plural sheets of recording paper P that are fed by being overlapped are more likely to be separated from each other while being transported, compared to a path not provided with the pair of transport rollers 36. Thus, whether or not the length of a sheet of recording paper P transported along the transport path 30 is within an assumed range is identified with high accuracy on the basis of a detection result generated by the first path sensor 91A, not using a detection result generated by the second path sensor 91B.

In the above-described exemplary embodiments, a description has been given of a case where a sheet of recording paper P accommodated in an accommodating unit is transported. Alternatively, the exemplary embodiments may be applied to a case where a sheet of recording paper P held by the foldable manual sheet feeder 39 is transported. In the example illustrated in FIG. 1, if sheets of recording paper P held by the foldable manual sheet feeder 39 are taken by the feed roller 42 and are fed to the auxiliary transport path 40 while being overlapped each other, the sheets are likely to be separated from each other by the two pairs of transport rollers 44 provided along the path leading to the pair of positioning rollers 38. Thus, in the sheet length identification process program according to an accommodating unit illustrated in FIGS. 7A and 7B, a positive determination is made in step 400, and steps 404 to 430 are performed.

In the above-described exemplary embodiments, a description has been given of the case of estimating a sheet length on the basis of an elapsed time from the execution of the transport start process. Alternatively, a sheet length may be estimated on the basis of the time period from when the first path sensor 91A shifts from the ON-state to the OFF-state to when the first path sensor 91A shifts to the ON-state again.

In the above-described exemplary embodiments, a description has been given of a case where two sensors, that is, the first path sensor 91A and the second path sensor 91B, are provided along the transport path 30. Alternatively, three or more path sensors may be provided along the transport path 30. In that case, sheet lengths are estimated on the basis of detection results generated by the three sensors. If at least one of the estimated sheet lengths is out of an assumed range, an alarm signal is output. If all the estimated sheet lengths are within the assumed range, an alarm signal is not output. Accordingly, whether or not a sheet of recording paper P having a preset sheet length is being transported is determined more accurately.

In the second exemplary embodiment, a description has been given of a case where passing of a sheet of recording paper P taken from the accommodating unit with which the pair of transport rollers 38 is associated is detected by using the first path sensor 91A disposed on the upstream side in the transport direction among the first path sensor 91A and the second path sensor 91B. Alternatively, passing of the sheet may be detected by using the second path sensor 91B disposed on the downstream side in the transport direction. In this case, the sheet of recording paper P passes the second transfer unit 37 and the fixing device 100 before reaching the detection region of the second path sensor 91B. Thus, even if plural sheets of recording paper P are transported there while being overlapped each other, the sheets are likely to be separated from each other when passing the second transfer unit 37 and the fixing device 100. Therefore, in the case of estimating a sheet length by using a detection result generated by the second path sensor 91B, whether or not a sheet of recording paper P having a preset sheet length is being transported is determined more accurately than in the case of estimating a sheet length by using a detection result generated by the first path sensor 91A, which is positioned on the upstream side in the transport direction with respect to the second path sensor 91B. On the other hand, in the case of estimating a sheet length by using a detection result generated by the first path sensor 91A, whether or not a sheet of recording paper P having a preset sheet length is being transported is determined more quickly than in the case of estimating a sheet length by using a detection result generated by the second path sensor 91B, which is positioned on the downstream side in the transport direction with respect to the first path sensor 91A.

In the above-described exemplary embodiments, a sheet of recording paper P is transported. Alternatively, an overhead projector (OHP) sheet or a color filter used for manufacturing a liquid crystal display may be transported. That is, any type of sheet may be transported as long as an image may be formed thereon.

In the above-described exemplary embodiments, various process programs are stored in advance in the ROM 152. Alternatively, the various process programs may be provided in the form of being stored in a computer readable storage medium, such as a compact disc-read only memory (CD-ROM), a digital versatile disc-read only memory (DVD-ROM), or a universal serial bus (USB) memory. Alternatively, the various process programs may be distributed via a wired or wireless communication medium.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet identification device comprising:

a plurality of detecting units that are provided along a transport path along which a sheet is transported by a transport unit and that detect passing of the sheet;

an estimating unit that performs a plurality of estimates of a length in a transport direction of the sheet as a detection target, each estimate based on detection results generated by a respective one of the detecting units; and an output unit that outputs, if at least one of the estimated lengths is not a predetermined length, a signal indicating that a sheet having a length in the transport direction different from the predetermined length is being transported.

2. The sheet identification device according to claim 1, wherein:

the plurality of detecting units comprise a first path sensor and a second path sensor, the estimation unit performs a first estimate of the length of the sheet based on detection results generated by the first path sensor, and a second estimate of the length of the sheet based on detection results generated by the second path sensor, and the output unit outputs the signal when at least one of the first estimate and the second estimate is not the predetermined length.

3. The sheet identification device according to claim 2, wherein the second path sensor is located downstream of the first path sensor in the transport path.

4. The sheet identification device according to claim 1, wherein each estimate is determined based on a time measured between detection results of the respective detecting unit.

5. A sheet identification device comprising:

a plurality of detecting units that are provided along a transport path along which a sheet is transported by a transport unit and that detect passing of the sheet;

an estimating unit that estimates a length in a transport direction of the sheet as a detection target on the basis of individual detection results generated by the plurality of detecting units;

an output unit that outputs, if the length estimated by the estimating unit on the basis of at least one of the detection results is not a predetermined length, a signal indicating that a sheet having a length in the transport direction different from the predetermined length is being transported;

a feed unit that takes a sheet accommodated in an accommodating unit from the accommodating unit and feeds the sheet to the transport path; and a controller that controls the feed unit so that, if a length through which transport is to be assisted by the feed unit is preset as a length in the transport direction of a sheet to be transported, a feed operation is performed on the sheet until a predetermined time period elapses from when the feed unit starts feeding the sheet to a specific region of the transport path, the predetermined time period being a time period for feeding the sheet by the preset length.

6. A sheet identification device comprising:

a plurality of detecting units that are provided along a transport path along which a sheet is transported by a transport unit and that detect passing of the sheet;

an estimating unit that estimates a length in a transport direction of the sheet as a detection target on the basis of individual detection results generated by the plurality of detecting units;

an output unit that outputs, if the length estimated by the estimating unit on the basis of at least one of the detection results is not a predetermined length, a signal indicating that a sheet having a length in the transport direction different from the predetermined length is being transported;

a plurality of feed units that correspond to a plurality of accommodating units in which sheets to be transported are accommodated, that take the sheets accommodated in the plurality of accommodating units from the plurality of accommodating units, and that feed the sheets to the transport path, the transport unit including a positioning unit that performs positioning of the sheets fed by the plurality of feed units and that feeds the sheets to a specific region of the transport path; and a supplying unit that corresponds to at least one of the plurality of accommodating units, that receives a sheet fed by a corresponding one of the plurality of feed units, and that feeds the received sheet to the positioning unit, thereby supplying the sheet to the positioning unit, wherein the estimating unit estimates, if the supplying unit corresponds to one of the plurality of accommodating units from which the sheet has been taken by one of the plurality of feed units, a length in the transport direction of the sheet as a detection target on the basis of a detection result generated by one of the plurality of detecting units, and estimates, if the supplying unit does not correspond to one of the plurality of accommodating units from which the sheet has been taken by one of the plurality of feed units, a length in the transport direction of the sheet as a detection target on the basis of detection results generated by the plurality of detecting units.

7. The sheet identification device according to claim 6, wherein the estimating unit estimates, if the supplying unit corresponds to one of the plurality of accommodating units from which the sheet has been taken by one of the plurality of feed units, a length in the transport direction of the sheet as a detection target on the basis of a detection result generated by a detecting unit on an upstream side among the plurality of detecting units, and estimates, if the supplying unit does not correspond to one of the plurality of accommodating units from which the sheet has been taken by one of the plurality of feed units, a length in the transport direction of the sheet as a detection target on the basis of detection results generated by the plurality of detecting units.

8. The sheet identification device according to claim 6, wherein the estimating unit estimates, if the supplying unit corresponds to one of the plurality of accommodating units from which the sheet has been taken by one of the plurality of feed units, a length in the transport direction of the sheet as a detection target on the basis of a detection result generated by a detecting unit on a downstream side among the plurality of detecting units, and estimates, if the supplying unit does not correspond to one of the plurality of accommodating units from which the sheet has been taken by one of the plurality of feed units, a length in the transport direction of the sheet as a detection target on the basis of detection results generated by the plurality of detecting units.

9. An image forming apparatus comprising:

a sheet identification device comprising:

a plurality of detecting units that are provided along a transport path along which a sheet is transported by a transport unit and that detect passing of the sheet;

an estimating unit that estimates a length in a transport direction of the sheet as a detection target on the basis of individual detection results generated by the plurality of detecting units;

an output unit that outputs, if the length estimated by the estimating unit on the basis of at least one of the detection results is not a predetermined length, a signal indicating that a sheet having a length in the transport direction different from the predetermined length is being transported; and an image forming unit that forms an image corresponding to image information on a sheet transported to the transport path by the transport unit.

10. A computer readable medium storing a program causing a computer to execute a process for controlling an image forming apparatus including a plurality of detecting units that are provided along a transport path along which a sheet is transported by a transport unit and that detect passing of the sheet, the process comprising:

performing a plurality of estimates of a length in a transport direction of the sheet as a detection target, each estimate based on detection results generated by a respective one of the detecting units; and outputting, if at least one of the estimated lengths is not a predetermined length, a signal indicating that a sheet having a length in the transport direction different from the predetermined length is being transported.

11. The computer readable medium according to claim 10, wherein:

the plurality of detecting units comprise a first path sensor and a second path sensor, performing the plurality of estimates comprises performing a first estimate of the length of the sheet based on detection results generated by the first path sensor, and a second estimate of the length of the sheet based on detection results generated by the second path sensor, and the outputting comprises outputting the signal when at least one of the first estimate and the second estimate is not the predetermined length.

12. The computer readable medium according to claim 11, wherein the second path sensor is located downstream of the first path sensor in the transport path.

13. The computer readable medium according to claim 10, wherein each estimate is determined based on a time measured between detection results of the respective detecting unit.

* * * * *